United States Patent [19]

Taberlet

[11] Patent Number: 5,060,381

[45] Date of Patent: Oct. 29, 1991

[54] PAIR OF SCISSORS, IN PARTICULAR FOR USE IN THE CUTTING OF HAIR

[76] Inventor: Jean-Jacques Taberlet, Chez Désiré Route de Taninges, 74269 Les Gets, France

[21] Appl. No.: 566,545

[22] Filed: Aug. 13, 1990

[51] Int. Cl.[5] ..... B26B 13/00

[52] U.S. Cl. ..... 30/232; 30/194

[58] Field of Search ..... 30/232, 341, 194, 231

[56] References Cited

U.S. PATENT DOCUMENTS

| | | | |
|---|---|---|---|
| 242,000 | 5/1881 | Klaucke | 30/341 |
| 4,254,551 | 3/1981 | Megna et al. | 30/341 |
| 4,742,617 | 5/1988 | Gauvry | 30/341 X |

FOREIGN PATENT DOCUMENTS

| | | | |
|---|---|---|---|
| 3721261 | 2/1988 | Fed. Rep. of Germany | 30/232 |
| 2340179 | 7/1977 | France | 30/232 |

*Primary Examiner*—Timothy V. Eley
*Assistant Examiner*—Willmon Fridie
*Attorney, Agent, or Firm*—Roland Plottel

[57] ABSTRACT

Pair of scissors, in particular for the cutting of hair, having two elements articulated about a common spindle (6), each of which comprises a cutting blade (2, 3) extended beyond the axis of articulation by a limb (4, 5) equipped with an annular grip (9, 10) enabling the limb to be controlled by the end of a user's finger (7, 8), one of the annular grips receiving the ring finger (7) and the other the thumb (8) of the user.

16 Claims, 2 Drawing Sheets

FIG. 1
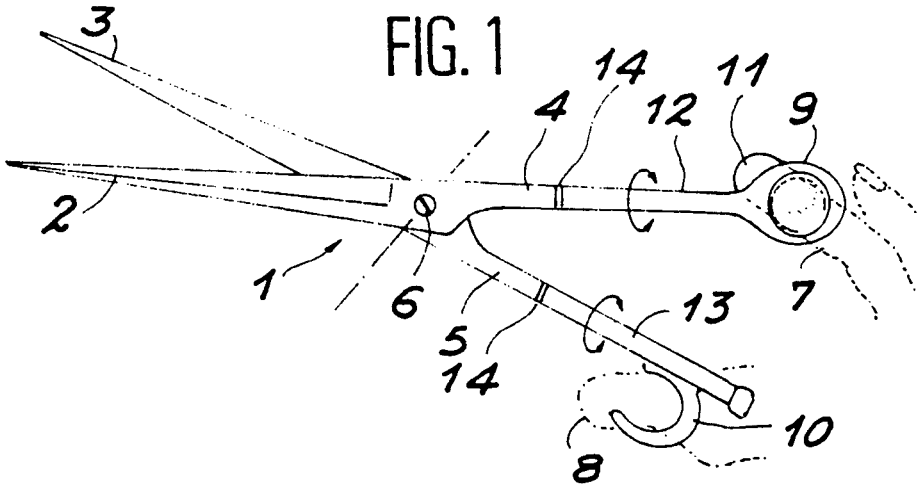
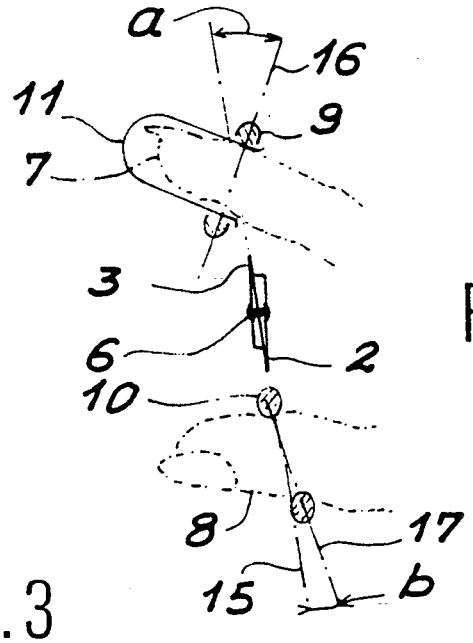
FIG. 2
FIG. 3
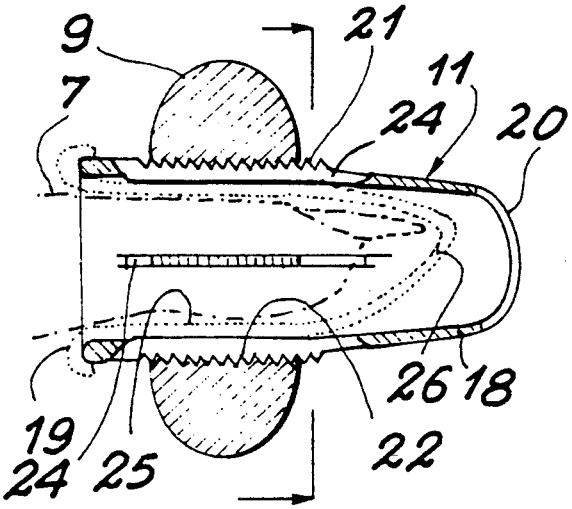
FIG. 4
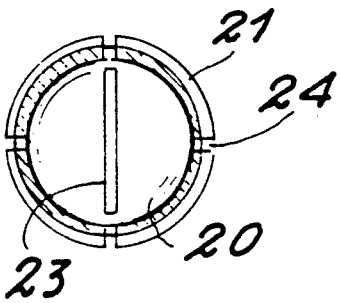

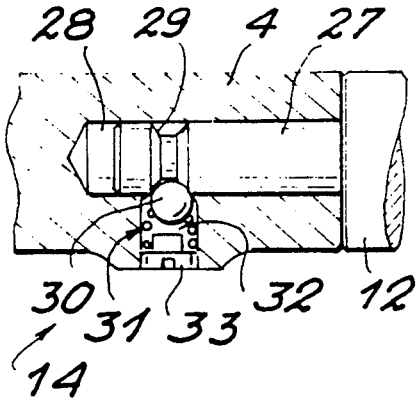
FIG. 5
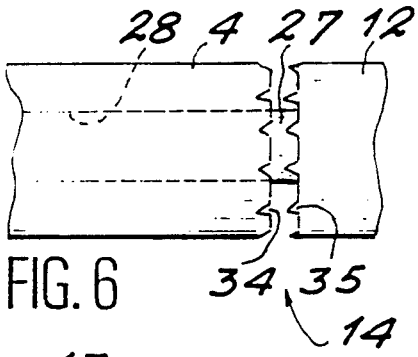
FIG. 6
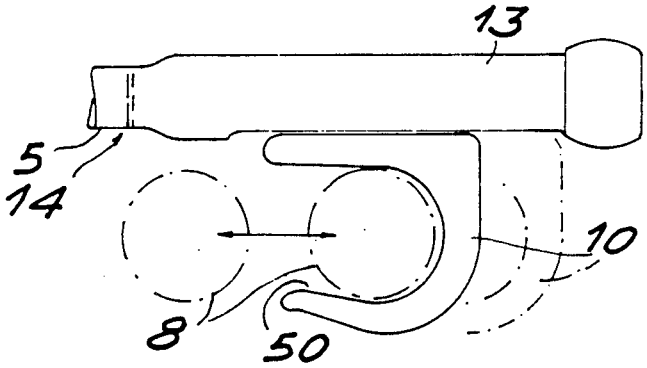
FIG. 7
FIG. 8
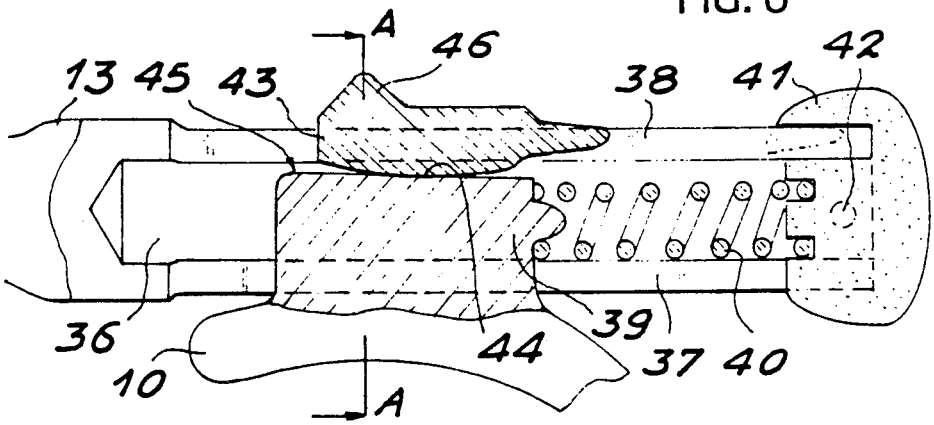
FIG 9
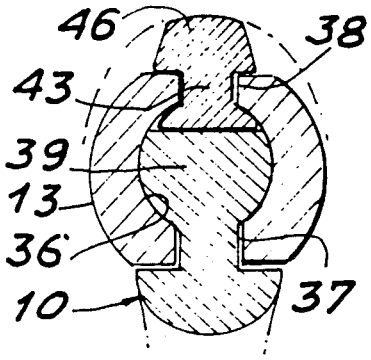
FIG. 10
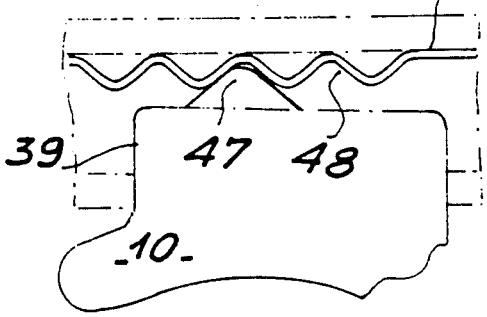

PAIR OF SCISSORS, IN PARTICULAR FOR USE IN THE CUTTING OF HAIR

The present invention relates to a pair of scissors intended in particular, although not exclusively, for the art of hairdressing for the cutting of the hair by a practitioner.

It is known that, for the practice of cutting the hair of a Client, the person skilled in the art must be able to keep the pair of scissors which he is using in a substantially constant position, practically in a vertical plane, irrespective of the location of the cutting on and around the Client's head and the relative position of the latter which, obviously, does not remain still for an entire hairdressing operation. Moreover, it is known that, in this particular art, the pair of scissors is always held in the hand by inserting the ring finger of the hand into one of the handles or annular grips of one of the limbs, the other annular grip of the second limb articulated on the first being provided in order to receive the thumb of the practitioner with which the latter controls, in its plane, the movement of the limb performing the cutting, the other limb held by the ring finger remaining fixed.

Now, it is recognized that, depending on the position of the head or the location of the cutting, the adaptation of the plane of the cutting is sometimes difficult, demanding in particular a variable rotation of the wrist, in some cases at the limit of the faculties of movement of the latter. Other dependent factors are the skilfulness of the practitioner, his experience but also his physical condition, in particular if he is subject to arthrosis, which limits the flexibility of his joints and his lumbar vertebrae.

Moreover, although a hairdresser's scissors are in general the property of the latter and are not frequently used by others, it is found that the manufacturers of these instruments do not supply such objects with adaptations of form and size within a wide range, making it possible to choose those which correspond best to the shape of the user's hand, taking into account the dimensions of his fingers, the surface of his palm, the gap between thumb and ring finger, etc. . . .

The subject of the present invention is an improved pair of scissors which overcomes this disadvantage, while providing in addition other noteworthy advantages, in particular by facilitating the adaptation to any shape of the hand of the practitioner, and also by making it possible to modify this adaptation as required, in particular the relative orientation of the cutting plane with respect to the fingers, the wedging of the ring finger on the corresponding limb, the relative position of the thumb on the other limb and, finally, the freedom of movement of this same thumb with respect to the annular grip receiving it.

To this end, a pair of scissors according to the invention having two elements articulated about a common spindle, each of which comprises a cutting blade extended beyond the axis of articulation by a limb equipped with an annular grip enabling the limb to be controlled by the end of a user's finger, one of the annular grips receiving the ring finger and the other the thumb of the user, is characterized in that one of the said limbs comprises, mounted in its annular grip, a transverse socket in the form of a cylindrical tube, optionally closed at one end and open at the other. Said socket may have in its external surface a thread which is able to cooperate with a threading of the same pitch made in the annular grip so as to adjust, as required, the relative position of the annular grip with respect to the socket, which receives and immobilizes the end phalanges of the ring finger of the user.

The invention thus makes it possible to immobilize the ring finger holding the normally stationary limb of the scissors, in a reliable and convenient manner, while facilitating in particular the adaptation of the socket to the shape and the anatomy of the finger which enters it. The socket can be adjusted in the annular grip into the best position depending on the size of the ring finger, its length, its thickness . . . In particular, and according to a particular feature, the socket can receive through its open end a cap for protecting the nail of the ring finger, especially if the user is female.

According to another feature of the invention, the scissors have, in one or the two limbs extending the blades, means ensuring the mobility of the annular grip, which is capable of modifying, as required, the inclination of this annular grip with respect to the cutting plane of the blades. This arrangement also enables the blades to be made interchangeable.

Advantageously, the annular grip has an extension equipped with a stub inserted forcibly into a housing provided at the end of the associated limb. Preferably also, locking means enable the limb and the extension of the annular grip to be made integral, once the relative orientation of these two parts has been adjusted. These means may consist in a ball-operated catch or interlockable notches or, alternatively, in any other mechanically equivalent locking solution.

The mobile annular grip is assembled on the upper part of the scissors by means of a regulating screw resisting to the pivoting, said screw being guided in the inner part of the scissors by a rigid socket. The regulating screw becomes blocked in the inner part of the scissors after having gone through the rigid body creating its own threading.

The different working positions of the annular grip are manually regulated by the user who can according to its choice change the axial position of the annular grip with respect to the scissors body, by means of a slight finger pressure towards the desired position. The contact surface between the annular grip and the scissors body is shaped as a crown. Each part of said crown comprises microteeth enabling a tight handling and therefore a good working position.

The elasticity, i.e. the needed force to let the annular grip to move around the scissors body is obtained by means of an elastic ring, placed under the screw head. Said ring has two main functions maintaining the annular grip in the desired poisition with respect to the scissors body and giving the necessary resistance to the effort for obtaining the mobility of the annular grip.

The annular grip, receiving either the ring finger or the thumb of the user, may thus be shifted axially while again improving the relative position of the fingers with respect to the blades, with a greater efficiency combined with a substantially increased convenience of use, in particular by avoiding an excessive flexing of the wrist.

According to yet another feature, the annular grip receiving the thumb is mounted so as to be movable longitudinally in a groove of the corresponding limb in order to make it possible for the position of this annular grip to be modified with respect to that of the other annular grip carrying the socket receiving the ring finger.

Preferably, the annular grip has a guiding lug inserted in the groove, a return spring being mounted between the lug and a lateral stop in the groove, in order to facilitate the movement and the immobilization of the annular grip by means of locking notches spaced out along the length of the groove, or by means of a cursor which can be moved parallel to the latter.

In addition and according to another feature, the annular grip receiving the thumb is open laterally in order to facilitate the release of the thumb if necessary, in particular when, in order to pull up the locks of hair, the user uses the thumb, the middle finger and the index finger, the scissors remaining held by the ring finger alone.

Other features and advantages of a pair of scissors made according to the invention will emerge later in the description which follows of an exemplary embodiment given as a guide and with no limitation being implied, with reference to the appended drawings, in which:

FIG. 1 is a general perspective view of a pair of scissors having all the improvements according to the invention, FIG. 2 is a diagrammatic view showing the relative position of the ring finger and the thumb of a user with respect to the cutting plane of the scissors, FIG. 3 is a view in cross-section on a larger scale of the adjustable socket provided to receive the ring finger, FIG. 4 is a side view of this socket, FIG. 5 is a view also on a larger scale of a limb of the pair of scissors, illustrating in a first alternative embodiment the mounting in this limb of the corresponding annular grip, FIG. 6 is a partial view of another alternative embodiment of the connection between the limb and the annular grip, FIG. 7 represents another detailed view of the limb associated with the annular grip receiving the thumb of the user, FIG. 8 is a detailed view on a larger scale of an alternative embodiment of the mounting according to FIG. 7, FIG. 9 is a view in cross-section along the line A—A of FIG. 8, FIG. 10 is a diagrammatic view of another alternative embodiment.

As can be seen from FIG. 1, the pair of scissors, designated globally by the reference 1, has, in a conventional manner, two blades respectively 2 and 3 each extended by a manoeuvring limb 4 or 5, beyond a common spindle 6. Preferably, the pair of scissors considered is more particularly intended for use by a practitioner in hairdressing for the cutting of the hair of a Client. To this end, and according to an entirely conventional arrangement in this field, the scissors are held by the hand of the user between the ring finger 7 of the latter and the end of his thumb 8, each of these fingers being respectively inserted into an annular grip 9 for the ring finger, provided at the end of the limb 4, and into an annular grip 10 for the thumb, provided at the end of the limb 5.

In the view illustrated in FIG. 1, the annular grips 9 and 10 are diagrammatically represented equipped with the improvements according to the invention, consisting in particular in the placing of an adjustable socket 11 in the annular grip 9, into which socket the end phalanx of the ring finger 7 is inserted, the limb 5 being designed in such a way that the annular grip 10 receiving the thumb 8 is adjustable in position along this limb, while at the same time permitting a lateral release of this thumb, which is necessary for achieving certain phases in the cutting of hair. The annular grips 9 and 10 each have an extension, respectively 12 and 13, the linking of which with the associated limbs 4 and 5 is carried out via a connecting element 14 enabling, in the manner which will be elucidated later, a relative shift of the plane containing each of the annular rips 9 and 10 with respect to the associated limb.

Of course, the size of the connecting element 14 fixed on branch 4 can be reduced in such a practical way that the annular grip 9 receiving the ring finger 7 be free to turn with respect to branch 4.

FIG. 2 shows diagrammatically how the preceding arrangements make possible, on the one hand, a better immobilization of the ring finger 7 in the socket 11 carried by the annular grip 9 and, on the other hand, a relative orientation which can be varied, as desired by the user, between the cutting plane 15 in which the blades 2 and 3 move, and the planes 16 and 17 of the annular grips 9 and 10, it being possible for the angles, a and b respectively, formed between these planes to be equal or different depending on the shape of the hand and the corresponding positions taken by the ring finger and the thumb.

In case where only the annular grip is free to turn with respect to branch 4, the connection point is nearer and creates an improved accuracy and an easier handling.

FIG. 3 illustrates on a larger scale the structure of the socket 11 mounted in the annular grip 9 in order to receive and immobilize the ring finger 7. This socket is composed essentially of a tubular element 18 open at one of its ends 19 through which the ring finger enters, the opposite end 20 being closed. In its external surface, the socket has a thread 21 enabling it to be positioned in a threading 22, made in the internal surface of the annular grip 9, while thus permitting, depending on whether the socket is more or less screwed into the annular grip, its transverse position to be adjusted with respect to the latter, depending on, in particular, the length of the end phalanx of the ring finger entering the socket. The base 20 of the socket advantageously has a groove 23 facilitating the relative rotation of the socket in the annular grip. Furthermore, there is usefully provided in the lateral surface of this socket slots 24 imparting thereto a certain radial flexibility in such a way that, once the socket is in place, these slots produce an appropriate self-locking of the socket on the annular grip.

The user may insert the ring finger directly into the socket or use a type of flexible cap 25 which has previously been fitted onto the phalanx of the finger before the latter is inserted into the socket. In particular, there may be provided in this cap an extension 26 in order to envelop and protect the nail of this phalanx.

FIGS. 5 and 6 illustrate two alternative embodiments of the connecting device 14 making it possible, in particular, to ensure the linking between the limbs, for example the limb 4, of the pair of scissors 1 and the extension, for example 12, which is associated with it as an elongation of the corresponding annular grip.

In the variant represented in FIG. 5, the elongation 12 has an axial stub 27 which is able to penetrate into a housing 28 provided in the limb 4, the stub and the housing having preferably slightly conical complementary forms. Moreover, the spigot 27 has a lateral groove 29 open towards the outside and into which there may snap a locking element comprising in particular a ball 30 subjected to the action of a spring 31 mounted in a recess 32 and immobilized by a closure plate 33. Thus these arrangements make it possible, once the stub 27 has been locked by the ball 30, to permit a relative rotation of the extension 12 with respect to the limb 4 and, consequently, a modification of the plane of the annular grip 9 with respect to the cutting plane containing the limb 4 and the blade 2. Of course, it goes without saying that an exactly similar arrangement is provided for the limb 5, the extension 13 and the annular grip 10.

In the variant diagrammatically illustrated in FIG. 6, the extension 12 again has a stub 27 which can be inserted into a housing 28 of the limb 4; in this alternative, however, once the relative orientation of the two parts has been chosen, the latter are locked in position as a result of the cooperation of notches 34 and 35 made facing each other on the one part and on the other.

FIG. 7 illustrates another improvement of the pair of scissors considered, making it possible in particular to ensure the longitudinal movement of the annular grip 10 receiving the end of the thumb of the user in accordance with the length of the extension 13 extending the limb 5.

In the variant illustrated in FIG. 8, the extension 13 has a hollow groove 36 equipped with two respectively opposite slots 37 and 38. The annular grip 10 is equipped with a lug 39 penetrating through the slot 37 into the groove 36 while being able to slide in the latter in order to vary its position with respect to the extension 13. A spring 40 is advantageously mounted between the lug 39 and a plug 41 forming an end stop closing the hollow groove 36. A transverse pin 42 makes it possible to immobilize the plug on the extension.

Moreover, there is mounted in the slot 38 a cursor 43 having a surface forming a cam 44, which is able to wedge in position the upper part 45 of the lug in order that the latter is kept immobile once its position has been decided, as desired by the user. The cursor preferably has a projecting part 46 which facilitates the manoeuvring thereof beyond the slot 38.

Finally, in an alternative embodiment, which is illustrated more diagrammatically in FIG. 10, the lug 39 of the annular grip 10 has a projecting rib 47 which cooperates with notches 48 made in a flexible slide 49 extending in the extension 13 parallel to the direction of movement of the annular grip, the cooperation of the rib with the various notches of the slide making it possible to determine, as desired, the position of immobilization chosen for the annular grip 10.

Finally, returning to FIG. 7, it can be seen that the annular grip 10, mounted in this way so as to be adjustable in the extension 13 of the limb 5, also has a part 50 open laterally, making it possible for the thumb 8 to be easily released, in particular when the user has to hold a lock of hair between the thumb and the index finger for example, the pair of scissors being, in this case, only held by the ring finger inserted into the socket 11.

An improved pair of scissors is thus produced, for which, irrespective of the cutting plane adopted, the relative position of the annular grips may be modified both laterally and, for at least one of these annular grips, with an adjustable spacing with respect to the axis of articulation of the blades. The mounting of the annular grip receiving the end of the thumb in an adjusting groove enables, in certain cutting positions, a to and from movement of the finger, the spring always enabling it subsequently to be returned to a good position. The detachable and orientable mounting of the annular grips with respect to the limbs makes it possible to vary the inclination of the wrist until the best position depending on the shape of the hand has been adopted and also to ensure, as required, the interchangeability of the blades. Moreover, the use of a socket to hold in position permanently the end phalanx of the ring finger imparts a particular feeling of comfort to the user of the scissors, the finger being maintained in an appropriate manner without torsion or compression.

Of course, it goes without saying that the invention is not limited to the exemplary embodiment more specifically described and represented above; on the contrary, is also encompasses all the variants. In particular, it would also be possible to provide, in the annular grip receiving the thumb, a half-open socket to make it easier to hold the scissors and orient the latter in or with respect to their cutting plane, while permitting a certain rotation of the thumb relative to this plane.

I claim:

1. Pair of scissors, in particular for the cutting of hair, comprising two articulated elements being disposed for movement about a common spindle (6), each of the elements having respective cutting blades (2, 3) extending beyond the spindle in one direction and each of the elements having respective limbs (4, 5) extending beyond the spindle in an other direction.

two annular grips (9, 10), one being disposed proximate each distal end of the limbs for respectively enabling the limbs to be controlled by an end phalange of a user's fingers (7, 8), wherein the one of the annular grips is adapted to receive the end phalange of ring finger (7) and an other of the annular grips is adapted to receive the end phalange of thumb (8) of the user, at least one of the limbs (4) having mounted in the one of the two annular grips (9), a tubularly configured transverse socket (11) and being closed at one end and open at an other, each of the limbs (4, 5) having an orientable disposed connection (14) intermediately positioned between the limbs and each of the adjacently disposed annular grips (9, 10) to provide inclination of plane (16, 17) of the annular grips with respect to cutting plane (15) of the blades (2, 3) and the socket being externally threaded (21) to cooperate with a threaded surface (22) of a same pitch made in the one of the two annular grips so as to provide adjustment of relative position of the annular grips with respect to the socket, which receives and immobilizes the end phalange of the ring finger or of the thumb of the user.

2. Pair of scissors according to claim 1, wherein the socket (11) has surface slots (24) imparting elasticity and flexibility which is able to immobilize the socket in the one of two annular grips (9) and produce self-locking of the socket on the one of two annular grips.

3. Pair of scissors according to one of claims 1 or 2, wherein the socket (11) receives via an open end (19) an end of the ring finger (7) covered by a cap (25) and having an extension (26) for protecting a nail of one of the user's fingers.

4. Pair of scissors according to claim 1, wherein the orientable connection (14) includes means for rotation of the limbs (4, 5) and the annular grips (9, 10) about a common axis.

5. Pair of scissors according to claim 4, wherein each of the annular grips has an extension means (12, 13) adapted with a stub (27) inserted forcibly into a housing (28) provided at an end of the limbs (4, 5).

6. Pair of scissors according to claim 5, wherein locking means (30, 34, 35) are provided to make integral the limbs (4, 5) and the extension means (12, 13) of the annular grips, once the relative orientation of these two means has been effected.

7. Pair of scissors according to claim 6, wherein the locking means consist of a ball-operated catch (30) inserted in an open groove (29) of the stub (27), under the effect of a support spring (31) mounted in a recess (32) which is provided in the limbs, opposite the housing (28).

8. Pair of scissors according to claim 6, wherein the locking means have interlocking notches (34, 35) respectively provided for facing each other on a periphery of the limbs (4, 5) and of the extension means (12, 13).

9. Pair of scissors according to claim 1 wherein the one of the two annular grips (10) for receiving the thumb (8) is mounted so as to be movable longitudinally in a groove (36) of the corresponding limb in order to make it possible to modify the position of the one of the two annular grips with respect to that of the other of the two annular grips carrying the socket (11) for receiving the ring finger (7).

10. Pair of scissors according to claim 9, wherein the one of the two annular grips (10) has a guiding lug (39) inserted in the groove (36), a return spring (40) being mounted between the lug and a lateral spot (41) in the groove.

11. Pair of scissors according to claim 10, wherein the one of the two annular grips is immobilized in position by locking means (43, 48).

12. Pair of scissors according to claim 11, wherein the locking means are composed of a cursor (43) which can be moved parallel to the groove (36) and having a part forming a cam (44) wedging the lug (39) in position.

13. Pair of scissors according to claim 11, wherein the locking means are composed of a flexible slide (49) having notches (48) spaced out along the length of the groove (36).

14. Pair of scissors according to any one of the claims 1 to 13, wherein the one of the two annular grips (10) receiving the thumb is open laterally in order to facilitate the release of the thumb (out of this annular grip).

15. Pair of scissors according to claim 14, wherein the one of the two annular grips (10) receiving the thumb also has a detachable socket which is half open laterally.

16. Pair of scissors particularly for the cutting of hair comprising two articulated elements being disposed for movement about a common spindle (6), each of the elements having cutting blades (2, 3) extending away from the spindle in one direction and each of the elements having limbs (4, 5) extending away from the spindle in another direction, two annularly configured grips (9, 10), each being securably disposed proximate a distal end of the limbs for enabling the limbs to be controlled by an end phalange of a user's fingers (7, 8), the two grips being adapted to receive the end phalange of the user's finger (7, 8), a tubularly configured transverse socket (11) being mounted in at least one of the two grips (9, 10), the limbs (4, 5) each having a connection (14) intermediately positioned between the limbs and each the adjacently disposed grips (9, 10) to provide inclination of a plane (16, 17) of the grips with respect to a cutting plane (15) of the blades (2, 3), and the socket being externally threaded (21) to cooperate with a threaded surface (22) of a same pitch made in at least the one of the two grips so as to provide adjustment of relative position of the grips with respect to the socket for receiving and immobilizing the end phalange of the user's finger.

* * * * *